United States Patent [19]

Yamagata et al.

[11] 4,454,395

[45] Jun. 12, 1984

[54] CIRCUIT BREAKER

[75] Inventors: Shinji Yamagata; Fumiyuki Hisatsune; Junichi Terachi; Kiyomi Yamamoto, all of Fukuyama; Hajimu Yoshiyasu, Itami; Yuichi Wada, Kawanishi, all of Japan

[73] Assignee: Mitsubishi Denki Kabushiki Kaisha, Tokyo, Japan

[21] Appl. No.: 351,311

[22] Filed: Feb. 22, 1982

[30] Foreign Application Priority Data

Feb. 27, 1981 [JP] Japan ..... 56-28896
Feb. 27, 1981 [JP] Japan ..... 56-28900
Feb. 27, 1981 [JP] Japan ..... 56-28901

[51] Int. Cl.[3] ..... H01H 33/10
[52] U.S. Cl. ..... 200/147 R; 200/144 R
[58] Field of Search ..... 200/144 R, 147 R, 304

[56] References Cited

U.S. PATENT DOCUMENTS 537,130 4/1895 Sperry ..... 200/304
2,821,594 1/1958 Latour ..... 200/147 R
3,402,273 9/1968 Davis ..... 200/144 R
3,555,471 1/1971 Mitskevich et al. ..... 200/147 R
3,599,130 8/1971 Murai .

FOREIGN PATENT DOCUMENTS 1765051 7/1971 Fed. Rep. of Germany .

*Primary Examiner*—Robert S. Macon
*Attorney, Agent, or Firm*—Wenderoth, Lind & Ponack

[57] ABSTRACT

A circuit breaker having means for quickly opening a pair of contacts, a U-shaped flux board which surrounds the conductors that have contacts attached to the end portions thereof, so that the electromagnetic repulsive force produced by the electric current that flows through the opposing conductors in opposite directions relative to each other, will be added to the operation of the contact-opening means. The circuit breaker of the invention is further equipped with arc shielding members surrounding the contacts, so that the arc established across the contacts will not stretch to the conductors in the vicinities of the contacts, and so that the arcing voltage is greatly increased.

6 Claims, 19 Drawing Figures

CIRCUIT BREAKER

BACKGROUND OF THE INVENTION

The present invention relates to a circuit breaker. More specifically, the invention relates to a novel circuit breaker in which a pair of contacts are quickly separated from each other when it is operated, the arcing voltage is rapidly raised so that the arc established between the contacts will not spread to the conductors in the vicinity of the contacts, and the arc is efficiently confined in a magnetic manner in order to quickly extinguish the arc.

In conventional circuit breakers, the arc established across the contacts has tended to spread to conductors in the vicinity of the contacts, and it has not been possible to sufficiently increase the arcing voltage. Moreover, it has not been possible to efficiently extinguish the arc, either.

SUMMARY OF THE INVENTION

The object of the present invention is to provide a circuit breaker having enhanced circuit breaking performance, in which means is provided which quickly separates a pair of contacts of the circuit breaker, arc shielding members surrounding said contact points are provided so that the arc established between the contacts will not spread to the conductors in the vicinity of contacts, and a U-shaped flux board is provided which effectively utilizes the magnetic flux generated by the electric currents that flow through the conductors to which are attached said pair of contacts, in order to utilize the magnetic repulsive force produced by the currents which flow through the contactors when said contacts are to be opened.

BRIEF DESCRIPTION OF THE DRAWINGS

In the drawings, the same reference numerals denote the same or corresponding portions.

DESCRIPTION OF THE PREFERRED EMBODIMENTS

Figure 1A:
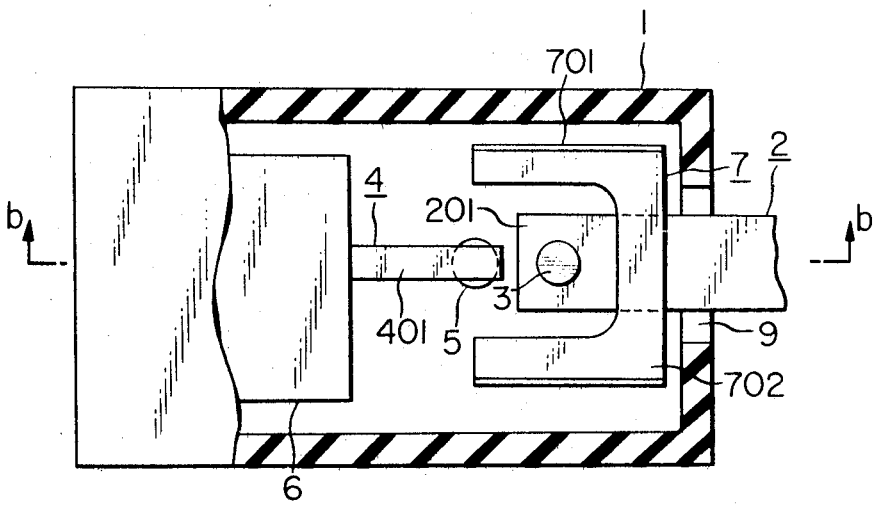
FIG. 1*a* is a sectional plan view of a conventional circuit breaker to which the present invention can be adapted.
Figure 1B:
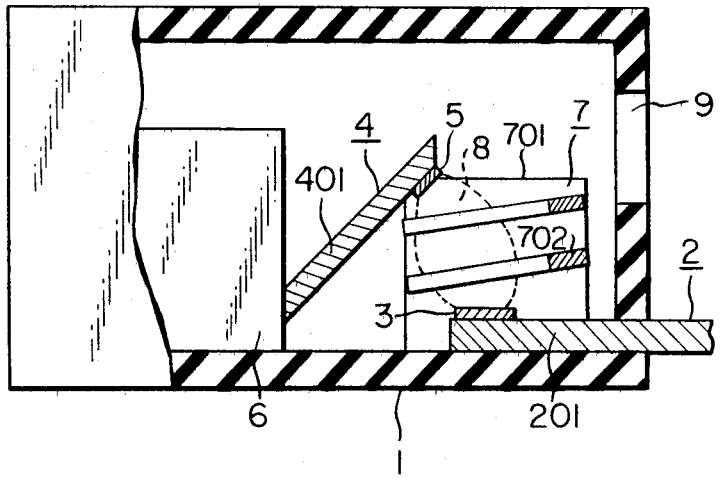
FIG. 1*b* is a sectional side view of the circuit breaker taken along the line b—b of FIG. 1*a;*

A circuit breaker to which the present invention can be adapted will be described below with reference to FIGS. 1*a* and 1*b*. The circuit breaker comprises a fixed contactor 2 and a movable contactor 4 accommodated in an enclosure 1 which is made of an insulating material. A fixed contactor contact 3 is attached to an electrically contacting surface of a fixed conductor 201 which forms the fixed contactor 2. Further, a movable contactor contact 5 is attached to a movable conductor 401 which forms the movable contactor 4. The movable conductor 401 is opened and closed by an operating mechanism 6, and the arc 8 established between the fixed contact 3 and the movable contact 5 is quenched and extinguished by an arc extinguishing plates 702 attached to side plates 701 of an arc extinguishing plate system 7. A high-pressure gas generated by the arc 8 escapes to the outside through an outlet port 9 formed in the enclosure 1. The operating mechanism and the arc extinguishing plate system are well known, and are taught, for example, in U.S. Pat. No. 3,599,130 issued to W. Murai et al.

Operation of the thus constructed conventional circuit breaker will be described below.

If the movable contactor contact 5 and the fixed contactor contact 3 are in contact, the electric power is supplied from the power supply side to the load side via the fixed conductor 2, fixed contactor contact 3, movable contactor contact 5 and movable conductor 4. Under this condition, if a heavy current such as a short-circuit current flows through this circuit, the operating mechanism 6 acts to separate the movable contactor contact 5 from the fixed contactor contact 3. In this case, arc 8 develops across the movable contactor contact 5 and the fixed contactor contact 3. The arcing voltage increases with the increase in the distance by which the movable contactor contact 5 is separated from the fixed contactor contact 3. At the same time, the arc 8 stretches toward the arc extinguishing plates 702 being attracted by the magnetic force. Therefore, the arcing voltage further increases. Thus, the arc current reaches a point of zero current; i.e., the arc 8 is extinguished, and the interruption is completed. During the course of interruption, a large amount of energy is generated between the movable contactor 5 and the fixed contactor contact 3 by the arc 8 within short periods of time, i.e., within several milliseconds. Accordingly, the temperature of the gas in the enclosure rises, and the pressure abruptly increases. The high temperature and high pressure gas, however, is released into the open air through the outlet port 9.

The circuit breaker which operates as described above should have a high arcing voltage. Depending upon the value of the arcing voltage, the arc current which flows during the breaking operation is restructed, or the magnitude of current which flows through the circuit breaker is reduced. Therefore, the circuit breaker which generates a high arcing voltage performs well for protecting various electric machines and equipment including wiring with which the circuit breaker is connected in series. In the circuits including a plurality of circuit breakers connected in series, the region of selective or cooperative breaking or the region of simultaneous breaking can be expanded.

In order to meet such requirements in the conventional circuit breakers of this type, the movable contactor conductor 401 has been separated at high speeds to achieve a high arcing voltage, or the shape of the arc extinguishing plates has been improved to extend the length of arc. However, there have been limits on the arcing voltage, and satisfactory results have not been obtained.

Here, the behavior of the arcing voltage across the fixed contactor contact and the movable contactor contact will be explained below prior to illustrating the circuit breaker of the present invention.

In general, the arc resistance has the following relation:

$$R=\rho(l/S)$$

where

R: arc resistance (Ω)

$\rho$: arc resistivity (Ω·cm)

l: arc length (cm)

S: sectional area of arc ($cm^2$).

In an arc of a current of several kiloamperes and a length shorter than 50 mm, however, the arcing space is occupied by the particles of contact material. The particles of contact materials are emitted in a direction at right angles to the surface of contact. Further, the particles when emitted are heated to nearly the boiling point of the contact material. Moreover, as soon as they are injected into the arcing space, the particles receive electrical energy, are placed in high-temperature and high-pressure conditions, become electrically conductive and flow alway from the contact at high speeds while being separated from each other in accordance with the pressure distribution in the arcing space. Thus, the arc resistivity $\rho$ and the sectional area S of arc in the arcing space are determined by the quantity of particles of contact material and by the direction of emission. Therefore, the arcing voltage is also determined by the behavior of particles of contact material.

Figure 2:
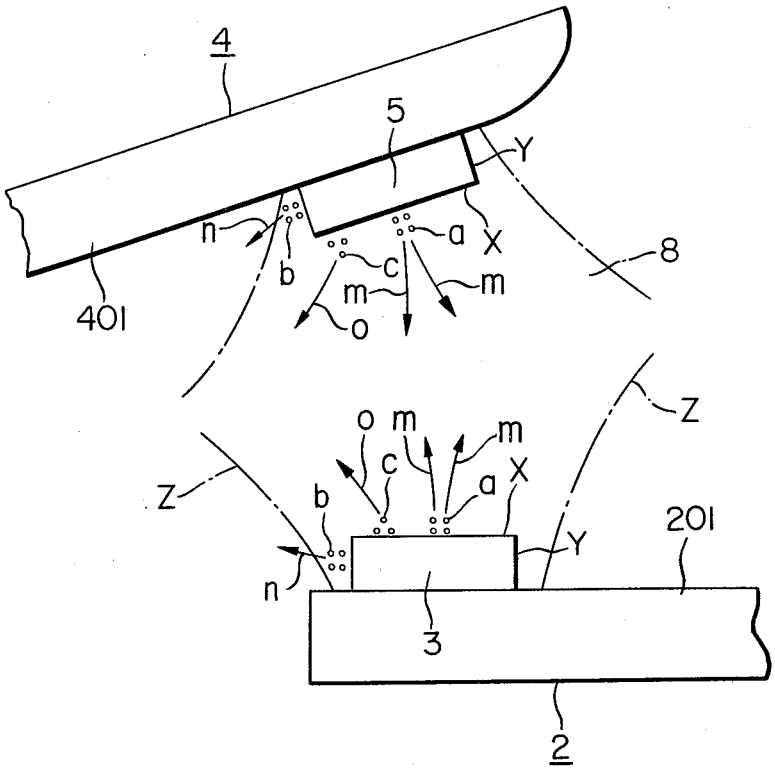
FIG. 2 is a schematic diagram illustrating the behavior of the arc established across the contacts of the circuit breaker of FIG. 1*a;*

The behavior of particles of electrode material will be explained below with reference to a conventional circuit breaker of FIG. 2, in which reference numeral 8 denotes the arc, planes X denote opposing surfaces on which the contacts 3 and 5 come into contact with each other, planes Y denote portions of contact surfaces and conductor surfaces which become electrically contacting surfaces in addition to the opposing surfaces X, dot-dash chain lines Z denote the contours of arc 8 which is formed between the contact 3 and the contact 5, and symbols a, b and c schematically represent particles of contact material emitted from the contacts, wherein a denotes particles emitted from the central portions of the opposing surfaces X, b denotes particles of contact material and particles of conductor emitted from portions Y of the contact surfaces and the conductor surfaces, and c denotes particles of contact material emitted from the periphery of the opposing surfaces X. After being emitted the particles flow as indicated by arrows m, n and o.

Other reference numerals denote the same members as those of FIG. 1.

Particles of contact material emitted from the contacts 3 and 5 are heated to the boiling point of the contact material, i.e., about 3,000° C. up to a temperature at which they become electrically conductive, i.e., at 8,000° C. or up to about 20,000° C. Consequently, the particles rob the arcing space of energy; i.e., temperature in the arcing space decreases, and arc resistance increases. The amount of energy robbed by the particles from the arcing space varies in proportion to the degree of temperature rise. Further, the degree of temperature rise is determined by the positions of particles in the arcing space and by the paths of emission. In the conventional circuit breaker shown in FIG. 2, however, the particles a emitted from the central portions of the opposing surfaces X rob the arcing space of large amounts of energy. However, the particles b emitted from portions Y of the contact surfaces and the conductor surfaces rob the arcing space of energy in amounts less than that robbed by the particles a. Further, the particles c emitted from the periphery of the opposing surfaces X rob the arcing space of energy in amounts midway between those robbed by the particles a and that robbed by the particles b.

That is, large amounts of energy are taken from the region where the particles a flow, and the temperature in the arcing space is decreased and, hence, the arc resistivity $\rho$ is increased. In the regions where the particles b and c flow, however, energy is not robbed in large amounts. Therefore, the temperature in the arcing space is decreased less, and the arc resistivity $\rho$ increases little. Moreover, since arc develops from the opposing surfaces X and from the contact surfaces Y, the sectional area of the arc increases, and the arc resistance decreases.

The flow of energy from the arcing space due to the particles of contact material keeps balance with the electrically injected energy. Therefore, if the particles emitted across the contacts are confined in increased amounts within the arcing space, the temperature in the arcing space can naturally be reduced greatly, whereby the the arc resistivity can be increased to greatly increase the arcing voltage.

In order to overcome the limitation imposed on the arcing voltage in the above-described conventional circuit breaker, the present invention provides a circuit breaker which is capable of strikingly increasing the arcing voltage by confining increased amounts of the particles emitted across the contacts within the arcing space, and by separating the contacts at high speeds.

Figure 3A:
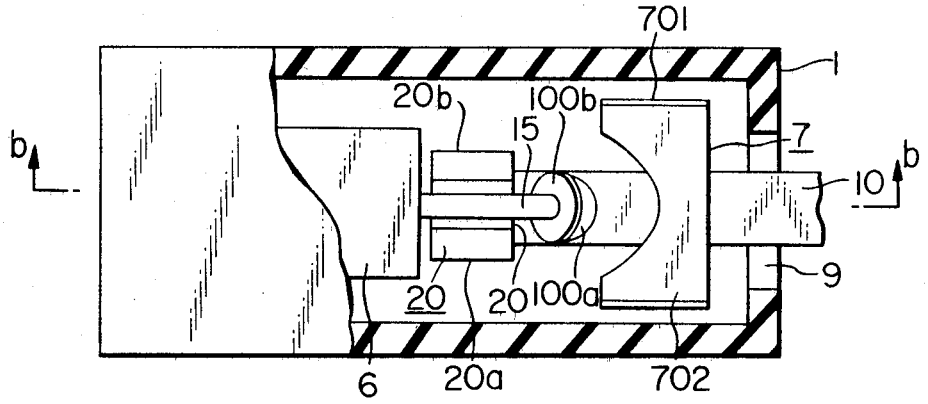
FIG. 3*a* is a sectional plan view of a circuit breaker according to an embodiment of the present invention.
Figure 3B:
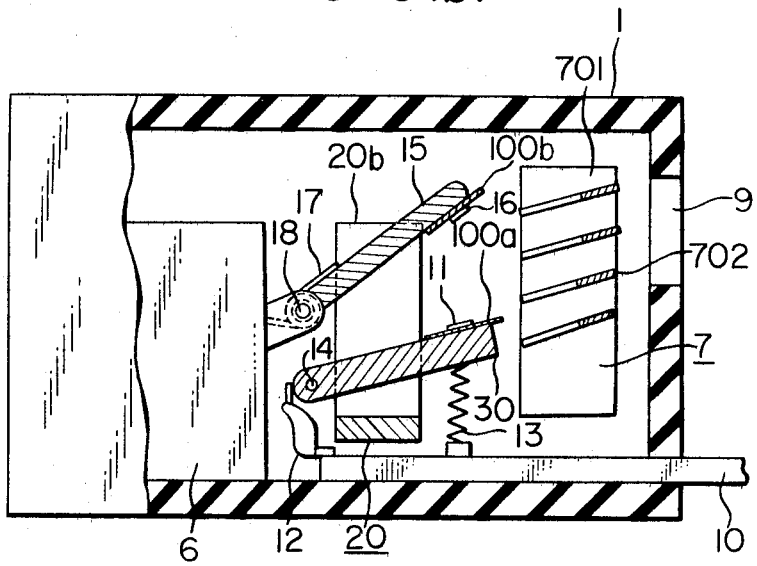
FIG. 3*b* is a sectional side view of the circuit breaker taken along the line b—b of FIG. 3*a;*

FIGS. 3*a* and 3*b* illustrate an embodiment of the present invention, in which an end of a fixed conductor 10 is connected to an end of a repulsively movable element 30 via a flexible copper twist wire 12. The repulsively movable element 30 is made of an electrically conductive material, rotatably supported at its one end by a pin 14, and has a repulsive contact 11 attached to the other end thereof. Reference numeral 15 denotes a toggle element which is made of an electrically conductive material, which makes or breaks the circuit being actuated by the operating mechanism 6, which has a toggle contact 16 attached to one end thereof, and which is rotatably supported at the other end by a pin 18. Contacts 11 and 16 at the ends of the repulsively movable element 30 and the toggle element 15 normally remain in the contacted state by the urging of springs 13 and 17. Repulsively movable element 30 and toggle element 15 extend in the same direction and generally parallel to each other when in the contacted state.

Figure 4:
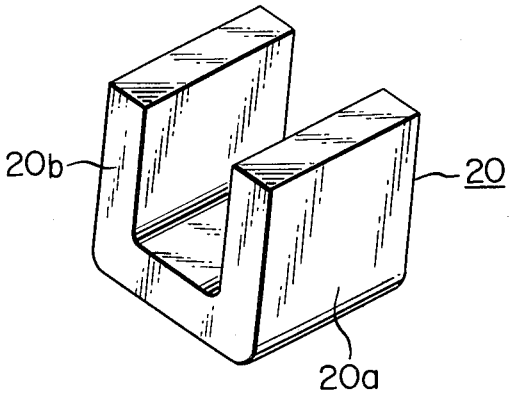
FIG. 4 is a perspective view of a flux board employed for the circuit breaker of the present invention.

In FIG. 4, reference numeral 20 denotes a substantially U-shaped flux plate made of a magnetic material, which has side pieces 20*a* and 20*b* that are opposed to each other with the repulsively movable element 30 and the toggle element 15 being interposed therebetween.

The flux plate concentrates the magnetic flux generated by the current flowing through the repulsively movable element 30 and the toggle element 15 between the side pieces 20*a* and 20*b*. The two elements have the contacts at the ends opposite the rotatably supported ends and, hence, the electric current flows through these elements in the opposite directions relative to each other, whereby the two elements produce magnetic repulsive force. When the circuit is being broken, the magnetic repulsive force overcomes the forces of the springs 13 and 17, and causes the contacts to be rapidly separated from each other simultaneously with the operation of the operation mechanism 6.

Figure 6A:
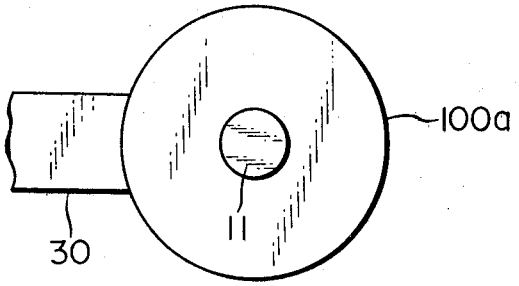
FIG. 6*a* is a plan view of an embodiment of the arc shielding member which can be used for the circuit breaker of the present invention.
Figure 6B:
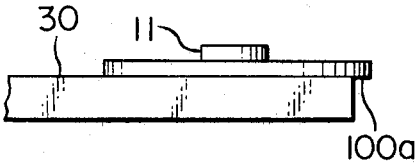
FIG. 6*b* is a side view of the embodiment of FIG. 6*a;*
Figure 6C:
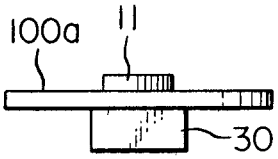
FIG. 6*c* is a front view of FIG. 6*a;*

Reference numeral 100*a* denotes an arc shielding member which is made of a material having resistivity greater than that of the repulsively movable element 30, and which is so placed on the repulsively movable element 30 that the periphery of the repulsive contact 11 is surrounded, as shown in FIGS. 6*a* to 6*c*. The arc shielding member 100*a* can be formed, for example, by coating the repulsively movable element 30 with a high-resistance material such as ceramic material by plasma-jet melt injection, or by attaching a plate made of a high-resistance material to the repulsively movable element 30. In addition to organic or inorganic insulation materials, examples of the high-resistance material include high-resistance metals such as nickel, iron, copper-nickel, copper-manganese, copper-manganin, iron-carbon, iron nickel, iron-chromium, and the like.

Reference numeral 100*b* denotes an arc shielding member which is made of a material having resistivity greater than that of the toggle element 15, and which is disposed on the toggle element 15 so as to surround the periphery of the toggle contact 16. The arc shielding member 100*b* is formed in the same manner as the above-described arc shielding member 100*a*.

The operation will be illustrated below. The toggle element 15 is actuated by the operating mechanism 6 in a customary manner in response to shortcircuiting current flow or the like. Here, however, the repulsively movable element 30 and the toggle element 15 are opposed to each other, and are rotatably supported at the corresponding ends. Therefore, when a heavy current such as short-circuit current flows, the repulsively movable element 30 and the toggle element 15 receive the electromagnetic force expressed by the vector product of current and magnetic flux, and are urged away from each other by this force. In the embodiment of the present invention, furthermore, the flux plate 20 is provided. Therefore, very small reluctance is produced in the magnetic field established by the current which flows through the repulsively movable element 30 and the toggle element 15, whereby a strong magnetic repulsive force is produced so that the toggle element 15 and the repulsively movable element 30 separate from each other at high speeds.

Described below is the behavior of particles of contact material in the column of the arc established between the contact 11 and the contact 16.

Figure 5:
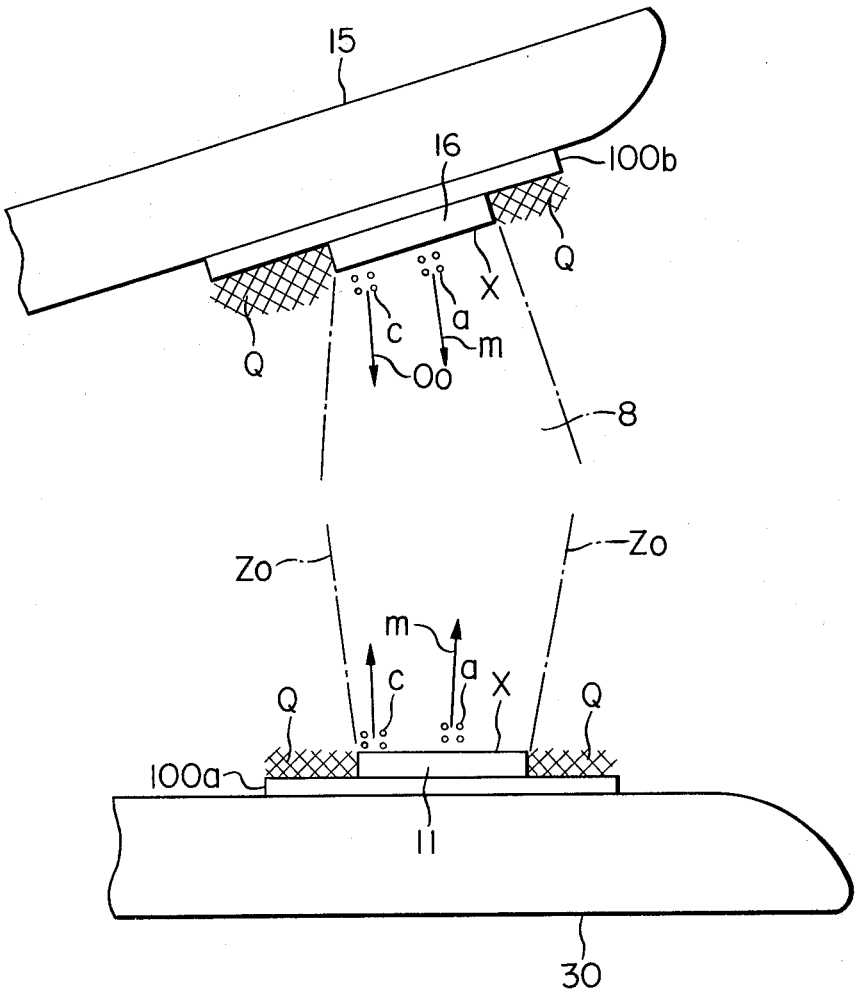
FIG. 5 is a schematic diagram illustrating the function of an arc shielding member employed in the circuit breaker of the present invention.

With reference to FIG. 5, the arc shielding members 100*a* and 100*b* are provided for the repulsively movable element 30 and for the toggle element 15 so as to be opposed to the arcing space, surrounding the peripheries of the opposing contacts 11 and 16, as described with reference to FIGS. 3*a* and 3*b*. In FIG. 5, furthermore, symbols X, a, c and m represent the same as in FIG. 2. In FIG. 5, however, Zo denotes contours of the arc 8 which is converged by the arc shielding members, Oo denotes flow of particles c of contact material along paths different from those of the conventional device owing to the provision of the shielding members, and Q denotes space (hatched areas) where the pressure is increased compared with that of the conventional device without arc shielding members, since the pressure produced by the arc 8 is reflected by the arc shielding members 100*a*, 100*b*.

The particles of contact material between the contacts of circuit breaker behave as described below. That is, the pressure in space Q never becomes greater than the pressure in the space of arc 8, but is very high compared with when the arc shielding members 100*a* and 100*b* are not provided. Therefore, a very high pressure in space Q established by the arc shielding members 100*a* and 100*b* works to confine the spread of arcing space 8, i.e. squeezes the arc 8 into a narrow space. This means that the flows of particles a, c emitted from the opposing surfaces X are confined in the arcing space. Therefore, the particles of contact material emitted from the opposing surfaces X are effectively injected into the arcing space, whereby large amounts of particles effectively injected into the arcing space rob the arcing space of large amounts of energy compared with the conventional device. Therefore, the arcing space is markedly quenched, the arc resistivity, i.e., arc resistance, is greatly increased, and the arcing voltage is strikingly increased.

When a heavy current flows, the toggle element and the repulsively movable element 30 separate from each other at very high speeds as described earlier. Accordingly, the arc shielding members 100*a* and 100*b* move at high speeds too. The arc shielding members which move at high speeds cause the pressure in the arcing space to be decreased, so that the above-described effect is promoted, and contribute to greatly increase the arcing voltage between the toggle element 15 and the repulsively movable element 30.

FIGS. 6*a*, 6*b* and 6*c* illustrate an embodiment of the arc shielding member employed for the circuit breaker of FIGS. 3*a*, 3*b*, as viewed from the repulsively movable element 30. The arc shielding member on the of the toggle element 15 is also provided to correspond to that of FIGS. 6*a*, 6*b* and 6*c*. In this embodiment, the arc shielding member 100*a* is formed in a circular shape together with the contact 11 and is located concentrically therewith to uniformly squeeze the arc from the circumference thereof.

The arcing phenomenon in the circuit breaker was described already with reference to FIG. 5, in which an excess of current flow relative to the rated current of the breaker, i.e., an excess of current greater than, for example, 5,000 amperes, flowed through the circuit breaker having a rated current of, for example, 100 amperes. However, when a current of smaller than 600 amperes flows through the circuit breaker having a rated current of 100 amperes, the breaking performance at the point of current zero becomes a problem, i.e., the insulation recovery force in the arcing space at a point of current zero becomes a problem rather than the current-limiting performance which restrains the circuit current by increasing the arcing voltage. This is for the following reasons. The breaking current If is given by the relation, $$If = V/Z$$

where

If: breaking current

V: circuit voltage

Z: circuit impedance.

When a small current is flowing, however, the circuit impedance is considerably greater than the arc resistance, and the current is limited very little by the arc. Therefore, a point of current zero takes place at a moment which is determined by the impedance of the circuit. Under such a condition, if the circuit has a large impedance and a large inductance, the circuit has a high instantaneous value of voltage at the point of current zero. To break the circuit, therefore, insulation in the arcing space must be recovered for a voltage differential between the circuit voltage and the arcing voltage.

On the other hand, when the circuit is to be broken by a heavy current, i.e., when the circuit has a small impedance, the current is greatly limited by the arc, the point of current zero changes greatly depending upon the degree of current limitation, the point of current zero is reached when the insulation by the arc is recovered sufficiently, and the circuit is broken predominantly by the recovered insulation of the arc.

As illustrated in the foregoing, the breaking of small currents often requires more difficult breaking performance than the breaking of heavy currents. The force of insulation recovery in space is greatly affected by the quenching of heat in the positive column of arc. To effectively quench the heat in the positive column, the positive column of arc is stretched for small currents, and the heat is directly adsorbed by the cooling member. To fulfill this purpose, an arc extinguishing plate means is employed; which is generally made of a magnetic member in such a shape as to attract and stretch the arc.

Figure 7:
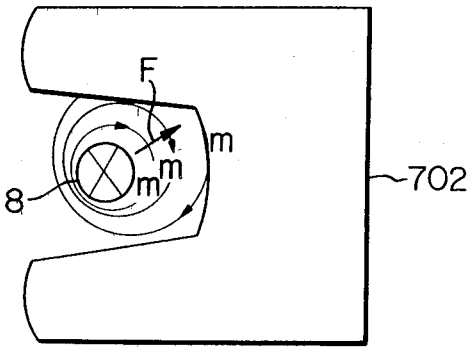
FIG. 7 is a plan view illustrating the general function of the arc extinguishing board.

FIG. 7 illustrates a relation between the arc 8 and an arc extinguishing plate 702, wherein the arc 8 is taking place relative to the arc extinguishing plate 702, and the current is flowing in a direction perpendicular to the surface of the drawing from in front of the drawing to the rear of the drawing. The magnetic field established by the arc is indicated by symbol m. In this setup, the magnetic field around the arc 8 is distorted because it is affected by the magnetic arc extinguishing plate 702; the magnetic flux in space close to the magnetic member becomes small. Owing to the electromagnetic force, therefore, the arc 8 is drawn in the direction indicated by F, i.e., toward the arc extinguishing plate 702. Thus, the arc is stretched, the heat is absorbed by the arc extinguishing plate 702, and the insulation in the positive column recovers more quickly.

Figure 8A:
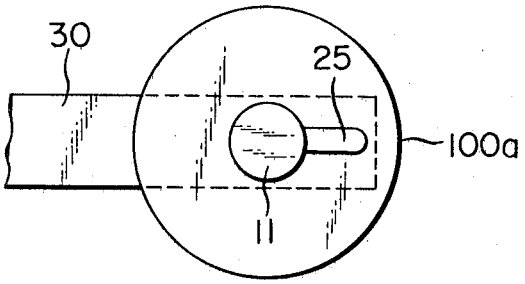
FIG. 8*a* is a plan view of another embodiment of the arc shielding member which can be used for the circuit breaker of the present invention.
Figure 8B:
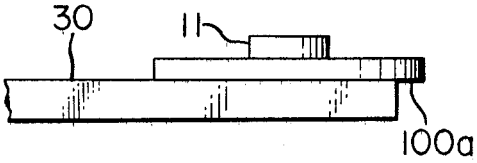
FIG. 8*b* is a side view of the arc shielding member of FIG. 8*a;*
Figure 8C:
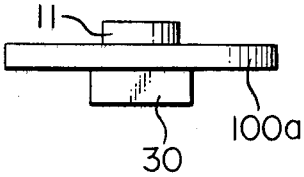
FIG. 8*c* is a front view of the arc shielding member of FIG. 8*a;*
Figure 9:
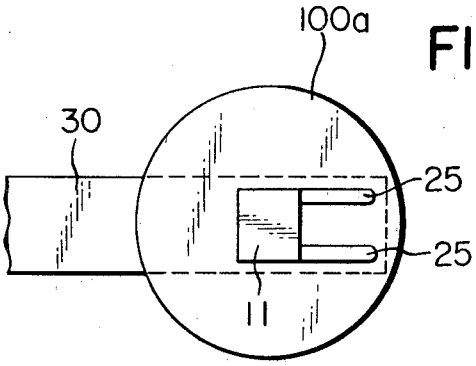
FIG. 9 is a plan view of another embodiment of the arc shielding member according to the present invention.

FIGS. 8*a* to 8*c* illustrate another embodiment, in which the arc is moved toward the arc extinguishing plate so that the arc extinguishing plate will function more effectively. In this embodiment, a groove 25 is formed in the arc shielding member 100*a* running outwardly starting from the contact 11. A portion of the conductor 30 is exposed in the groove 25 contiguous with the contact 11. FIG. 9 illustrates a further embodiment having a square contact 11 with two grooves 25 extending from the corners thereof. The side view and the front view of the arc shielding members of this embodiment are the same as FIGS. 8*b* and 8*c*.

In FIGS. 8*a*, 8*b*, 8*c* and 9, the groove 25 extends toward the arc extinguishing plate 702. Therefore, the arc 8 is attracted by the arc extinguishing plate 7 and is guided by the groove 25; i.e., the positive column of arc is stretched more effectively. Accordingly, the positive column of arc comes into direct contact with the arc extinguishing plate 7 where large amounts of heat are absorbed. That is, the positive column is sufficiently quenched, and the insulation recovery is increased for small currents.

Figure 10A:
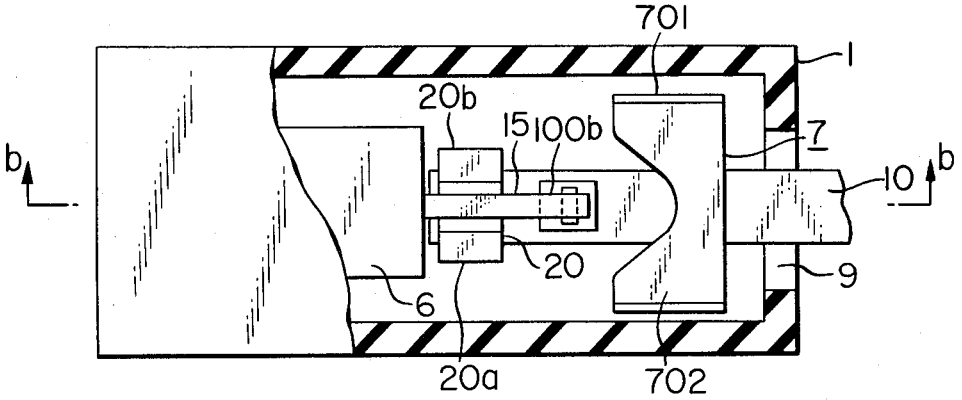
FIG. 10*a* is a sectional plan view of a circuit breaker according to a further embodiment of the present invention.
Figure 10B:
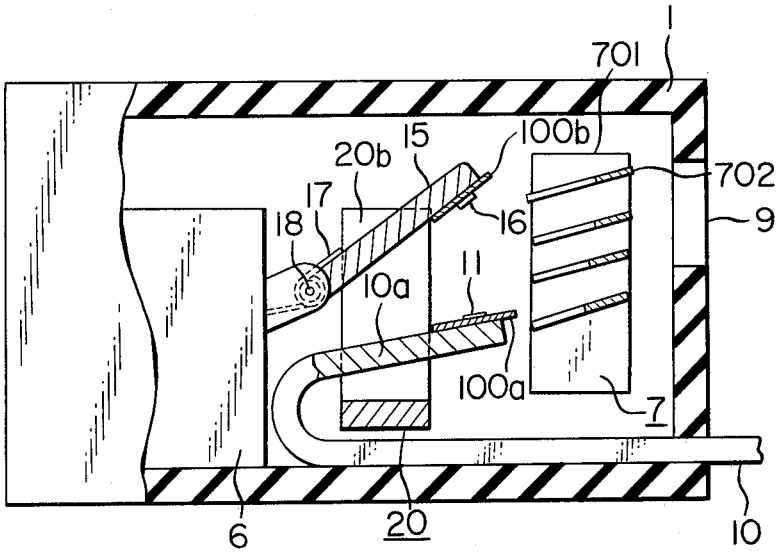
FIG. 10*b* is a sectional side view of the circuit breaker taken along the line b—b of FIG. 10*a;*

FIGS. 10*a* and 10*b* illustrate still another embodiment of the present invention, in which the end of a fixed element 10 is bent back on itself in a U-shape, and a fixed contactor contact 11 is attached to the end of the bent portion 10*a*. Reference numeral 15 denotes a toggle element composed of an electrically conductive material which makes or breaks the circuit and which is actuated by the operating mechanism 6. The toggle element 15 has a toggle contact 16 attached to one end thereof, and is rotatably supported at the other end by a pin 18. The bent portion 10*a* of the fixed element 10 and the toggle element 15 are so opposed that the contacts 11 and 16 will make or break the circuit. Reference numeral 17 denotes a spring. The flux plate 20 is composed of a substantially U-shaped magnetic material as shown in FIG. 4 having side pieces 20*a*, 20*b* opposed to each other with the bent portion 10*a* of the fixed element 10 and the toggle element 15 being interposed therebetween. The arc shielding member 100*a* is made of a material having resistivity greater than that of the fixed element 10 as illustrated in the embodiment of FIGS. 3*a*, 3*b*, and is disposed on the fixed element 10 so as to surround the outer periphery of the fixed contact 11. Another arc shielding member 100*b* is made of a material having resistivity greater than that of the toggle element 15, and is so disposed on the toggle element 15 as to surround the periphery of the toggle contact 16. The arc shielding member 100*b* is formed in the same manner as the above-described arc shielding member 100*a*.

In this embodiment, the toggle element 15 is actuated by the operating mechanism 6 in the customary manner. As described above, however, the fixed element 10 and the toggle element 15 are opposed, and the toggle element 15 is rotatably supported at its one end. When a heavy current such as short-circuit current flows, therefore, both the fixed element 10 and the toggle element 15 receive electromagnetic force expressed by a vector product of current and magnetic flux. In this embodiment, however, since the flux plate 20 is provided, very little reluctance is produced by the magnetic field established by the current which flows through the fixed element 10 and the toggle element 15. Accordingly, an intense electromagnetic repulsive force is produced to open the toggle element 15 at high speeds.

Figure 11A:
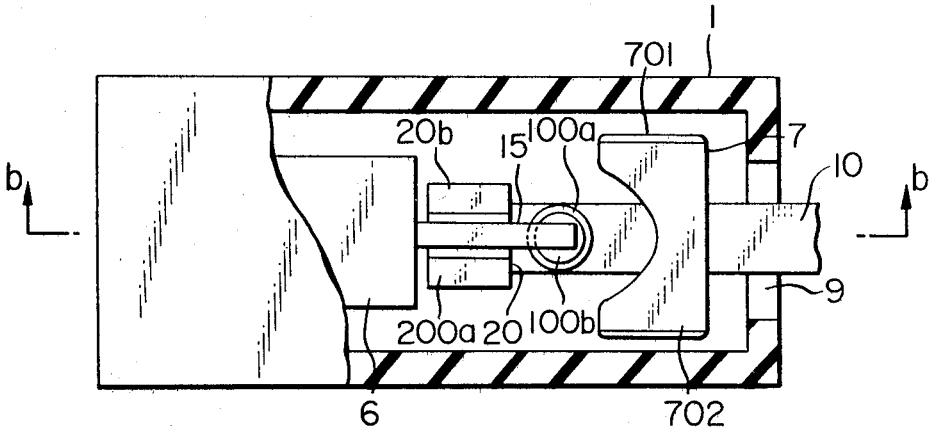
FIG. 11*a* is a sectional plan view of a circuit breaker according to still another embodiment of the present invention.
Figure 11B:
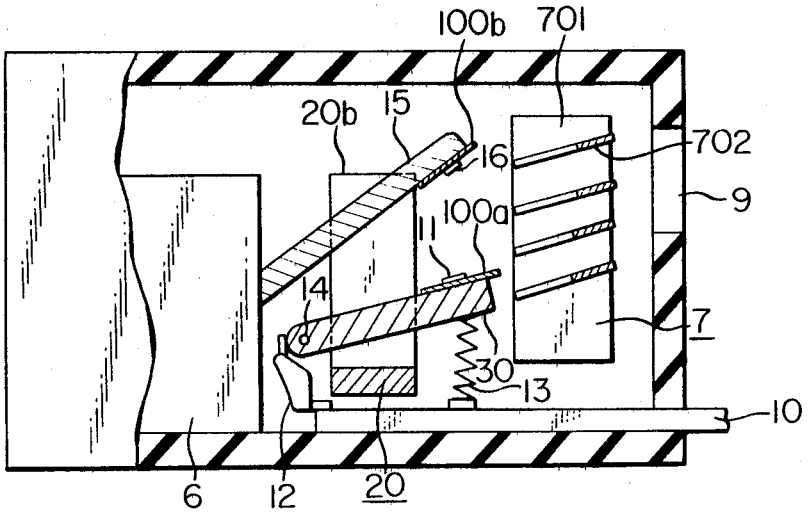
FIG. 11*b* is a sectional side view of the circuit breaker taken along the line b—b of FIG. 11*a.*

FIGS. 11*a* and 11*b* illustrate a still further embodiment, in which an end of a fixed conductor 10 is connected to an end of the repulsively movable element through the flexible copper twist wire 12. The repulsively movable element is rotatably supported at its one end by a pin 14 and has a repulsive contact 11 attached to the other end thereof. The toggle element 15 is made of an electrically conductive material which makes or breaks the circuit being actuated by the operating mechanism 6, and has a toggle contact 16 attached to one end thereof. The repulsively movable element 30 and the toggle element 15 are so opposed that their contacts 11 and 16 will make or break the circuit. Reference numeral 13 denotes a spring. The flux plate 20 is made of a substantially U-shaped magnetic material having side pieces 20*a*, 20*b* opposed to each other as shown in FIG. 4, with the repulsively movable element 30 being interposed therebetween. As illustrated with reference to the embodiment of FIGS. 3*a*, 3*b*, the arc shielding member 100*a* is made of a material having resistivity greater than that of the repulsively movable element 30, and is so disposed on the repulsively movable element 30 as to surround the periphery of the repulsive contact 11. Another arc shielding member 100*b* is also made of a material having resistivity greater than that of the toggle element 15, and is so disposed on the toggle element 15 as to surround the periphery of the toggle contact 16. The arc shielding member 100*b* is formed in the same manner as the above-described arc shielding member 100*a*.

In this embodiment, the toggle element 15 is actuated by the operating mechanism 6 in a customary manner. Here, however, the repulsively movable element 30 and the toggle element 15 are opposed, and the repulsively movable element 30 is rotatably supported at its one end. Therefore, when a heavy current such as a short-circuit current flows, both the repulsively movable element and the toggle element 15 receive the electromagnetic force expressed by a vector product of current and magnetic flux, and are separated from each other. In this embodiment, however, since the flux plate 20 is provided, very small reluctance is produced in the magnetic field established by the current which flows through the repulsively movable element 30 and the toggle element 15. Therefore, an intense electromagnetic repulsive force is produced to open the repulsively movable element 30 at high speeds.

What is claimed is:

1. A circuit breaker comprising:

a pair of contactors, one of said contactors being a movable contactor which is relatively movable away from and toward the other contactor to open and close an electric circuit, current responsive means connected to said movable contactor for moving said movable contactor away from the other contactor in response to an excess current flow through said circuit breaker, each of said contactors having a conductor and a contact secured thereto, said contacts abutting each other when said conductors are close to each other and the conductors of said contactors, when said contactors are in position with said contacts abutting each other, extending generally side-by-side and being connected for causing current flow through said conductors to repel said conductors;

arc shields of a material having a resistivity greater than the material of said conductors and said contacts, one positioned on each of said contactors surrounding the periphery of said contacts for narrowing the arc generated between said contacts when said contacts separate, and increasing the pressure in the arc; and a U-shaped flux plate having spaced parallel legs between which said conductors extend for concentrating the flux from said conductors for enhancing the repulsive effect thereof.

2. A circuit breaker as claimed in claim 1 wherein the conductor of said movable contactor is rotatably supported at one end, and further has spring means urging said conductor in a direction to close said contacts.

3. A circuit breaker as claimed in claim 1 wherein the conductors of both said contactors are rotatably supported at corresponding ends and have the contacts on the free ends thereof, the conductor of said movable contactor being a toggle element and the conductor of said other contactor being a repulsively moving element, and both of said conductors having spring means urging them in a direction to close said contacts.

4. A circuit breaker as claimed in claim 1 wherein said conductor of said movable contactor is rotatably supported at one end and the conductor of the other contactor is bent back on itself in a U-shape with a free end located at a position opposed to the free end of the conductor of said movable contactor, and said contacts being attached to the free ends of the two conductors.

5. A circuit breaker as claimed in claim 1 wherein said conductor of said other contactor has one end rotatably mounted and is a repulsively moving element, and said conductors each having a spring means urging said conductors in a direction to close said contacts.

6. A circuit breaker according to claim 1 wherein said arc shielding members each having at least one groove therein extending away from the corresponding contact toward the free end of the conductor.

* * * * *